US005158062A

United States Patent [19]

Chen

[11] Patent Number: 5,158,062

[45] Date of Patent: Oct. 27, 1992

[54] ADAPTIVE AIR/FUEL RATIO CONTROL METHOD

[75] Inventor: Bor-Dong Chen, Dearborn, Mich.

[73] Assignee: Ford Motor Company, Dearborn, Mich.

[21] Appl. No.: 624,825

[22] Filed: Dec. 10, 1990

[51] Int. Cl.[5] ..... F02D 41/14

[52] U.S. Cl. ..... 123/674; 123/696

[58] Field of Search ..... 123/489, 480, 486; 364/431.05

[56] References Cited

U.S. PATENT DOCUMENTS

| | | | |
|---|---|---|---|
| 4,224,910 | 9/1980 | O'Brien | 123/489 |
| 4,306,529 | 12/1981 | Chiesa et al. | 123/440 |
| 4,309,971 | 1/1982 | Chiesa et al. | 123/480 |
| 4,354,238 | 10/1982 | Manaka et al. | 364/431.05 |
| 4,401,086 | 8/1983 | Miyagi | 123/489 |
| 4,461,261 | 7/1984 | Isomura et al. | 123/489 |
| 4,594,985 | 6/1986 | Fujimura et al. | 123/489 |
| 4,723,522 | 2/1988 | Samuel | 123/489 |
| 4,739,740 | 4/1988 | Ohkawara et al. | 123/489 |
| 4,867,125 | 9/1989 | Grevemeyer | 123/489 |
| 4,976,242 | 12/1990 | Sonoda et al. | 123/489 |

FOREIGN PATENT DOCUMENTS

| | | | |
|---|---|---|---|
| 64-29653 | 1/1989 | Japan | 123/480 |

*Primary Examiner*—Andrew M. Dolinar

*Attorney, Agent, or Firm*—Peter Abolins; Clifford L. Sadler

[57] ABSTRACT

The rich or lean status of an air/fuel control system is determined according to the difference between the time period that the normalized air/fuel ratio is greater than an upper limit and the time period that the normalized air/fuel ratio is less than a lower limit in equal number of successive rich and lean cycles when in closed-loop fuel operation. The degree of rich or lean of the system is proportional to the time period difference. An adaptive learning control correction factor is incremented or decremented by an adaptive amount proportional to the time period difference.

18 Claims, 6 Drawing Sheets

| VMAF | FN025 (VMAF) |
|---|---|
| 0.45 | 0 |
| 0.85 | 1 |
| 0.90 | 2 |
| 0.95 | 3 |
| 1.05 | 4 |
| 1.10 | 5 |
| 1.20 | 6 |
| 1.30 | 7 |
| 1.40 | 8 |
| 1.50 | 9 |
| 1.60 | 10 |
| 1.70 | 11 |
| 1.80 | 12 |
| 1.90 | 13 |
| 2.00 | 14 |
| 2.10 | 15 |
| 2.20 | 16 |
| 2.30 | 17 |
| 2.40 | 18 |
| 2.50 | 19 |
| 2.60 | 20 |
| 2.70 | 21 |
| 2.80 | 22 |
| 2.90 | 23 |
| 3.00 | 24 |
| 3.10 | 25 |
| 3.30 | 26 |
| 3.50 | 27 |
| 3.70 | 28 |
| 3.90 | 29 |
| 4.40 | 30 |
| 5.00 | 31 |

ADAPTIVE AIR/FUEL RATIO CONTROL METHOD

BACKGROUND OF THE INVENTION

1. Field of the Invention

The present invention relates to an adaptive learning air/fuel ratio control applied to a fuel injection system for an internal combustion engine.

2. Prior Art

Precise air/fuel ratio control is required for maximizing the reduction of hydrocarbon (HC), carbon monoxide (CO) and oxides of nitrogen (NOx) emissions. In order to achieve good air/fuel ratio control, closed-loop fuel control systems employing an exhaust gas oxygen (EGO) sensor to correct any air/fuel ratio errors have been used. Furthermore, adaptive air/fuel control methods have been used to achieve better air/fuel ratio control by reducing the time it takes for the feedback loop to find the set point, i.e., stoichiometry, subsequent to a change in the engine operating point or upon entering closed loop engine control.

In a fuel injection system with an adaptive air/fuel ratio control capability, the actual fuel injection time duration can be obtained by multiplying the basic fuel injection time duration based on the current operating condition by the learning control correction factor.

It is known, for example from U.S. Pat. No. 4,594,985, in an adaptive learning control to obtain the learning control correction factor by initially setting its value at a predetermined initial value. Its value is adjusted according to the mean value of each two successive end values of the air/fuel ratio feedback complementing factor in the constantly increasing and constantly decreasing mode. If the mean value is larger than a predetermined high limit value, the current value of the learning control correction factor is incremented by a predetermined amount. If the mean value is smaller than a predetermined low limit value, the current value of the learning control correction factor is decremented by a predetermined amount. If the mean value is between the high limit and the low limit, the current value of the learning control correction factor is unchanged.

Whether such a system is rich or lean is determined by the mean value of the two successive peak and valley values of the air/fuel ratio feedback complementing factor. If the mean value is greater than an upper limit, the system is considered to be running lean, the learning control correction factor is thus incremented in order to adjust the system towards stoichiometry. If the mean value is less than a lower limit, the system is considered to be running rich, the learning control correction factor is then decremented in order to adjust the system towards the stoichiometry. Also, the increment or decrement amount of the learning control correction factor is a predetermined constant.

Such a system has drawbacks, first, by using only the mean value of two successive end values it is not always possible to correctly determine if the system is running lean or rich. In addition, the mean value of the two successive end values of the air/fuel ratio does not tell how far off the system is operating away from the stoichiometry point. Moreover, by using a fixed increment amount or decrement amount to adjust the learning control correction factor, the adjusting amount may be too small in some situations and too large in other situations.

It is also known to have a system with open loop fuel control wherein the air/fuel ratio is determined by a predetermined table based on the engine operating conditions such as load, engine speed, engine coolant temperature, etc. During system closed-loop fuel operation, the air/fuel ratio is constantly decremented when the EGO sensor indicates lean until a transition from lean to rich is sensed and the air/fuel ratio is constantly incremented when the EGO sensor indicates rich until a transition from rich to lean is sensed. At the time when the EGO sensor senses a transition from rich to lean status, because of the transport delay of the system, the air/fuel ratio is in fact too large. In order to make the air/fuel ratio converge faster towards stoichiometry, the air/fuel ratio is decremented by an amount when the EGO sensor indicates a rich to lean transition. Likewise, the air/fuel ratio is incremented by an amount when the EGO sensor indicates a lean to rich transition.

Accordingly, in the normal closed-loop fuel operation, the interleaved lean cycle and rich cycle continue and the desired normalized air/fuel ratio should stay in the neighborhood of stoichiometry (i.e., 1.0) regardless whether it is in lean cycle or in rich cycle. Thus, the mean value of the air/fuel ratio in one complete lean and rich cycle gives a proper measure of the system's rich or lean status. If the mean value is greater than an upper limit, the system is rich. If it is less than a lower limit, the system is lean. Since the mean value is calculated over the period of a complete lean and rich cycle, this method is more accurate than the method taking the mean value of each two successive end values of the air/fuel ratio. However, this method requires more calculation than the previous method. It requires an accumulator for summing the air/fuel ratio and a counter for summing the number of air/fuel ratio reading over one complete rich and lean cycle. At the end of one complete rich and lean cycle, a divide operation is required to obtain the mean value of the air/fuel ratio.

It would be desirable to improve the adaptive learning control system for air/fuel ratio and remove the drawbacks as described above. In particular it would be desirable to have a system which is easier to implement.

SUMMARY OF THE INVENTION

In this invention, an air/fuel ratio system's rich or lean status is measured by the time period difference between the time period that the air/fuel ratio is greater than an upper limit and the time period that the air/fuel ratio is less than a lower limit in one complete (or more generally, equal number of successive) rich and lean cycle. If the time period that the air/fuel ratio is greater than an upper limit is greater than the time period that the air/fuel ratio is less than a lower limit in equal number of successive rich and lean cycles, the system is rich. Conversely, if the time period that the air/fuel ratio is less than a lower limit is greater than the time period that the air/fuel ratio is greater than an upper limit in equal number of successive rich and lean cycles, the system is lean. The time period difference also indicates the degree that the system is too rich or too lean. The bigger the time period difference is, the farther off the system is away from the stoichiometry. In accordance with the present invention, the adjustment amount for the learning control correction factor is determined by making it proportional to the time period difference.

The present invention provides a method which can more accurately determine whether the system is running rich or lean. It can also determine how far off the system is away form the stoichiometry point. It can therefore determine the proper adjusting amount.

DESCRIPTION OF THE PREFERRED EMBODIMENTS

Figure 1:
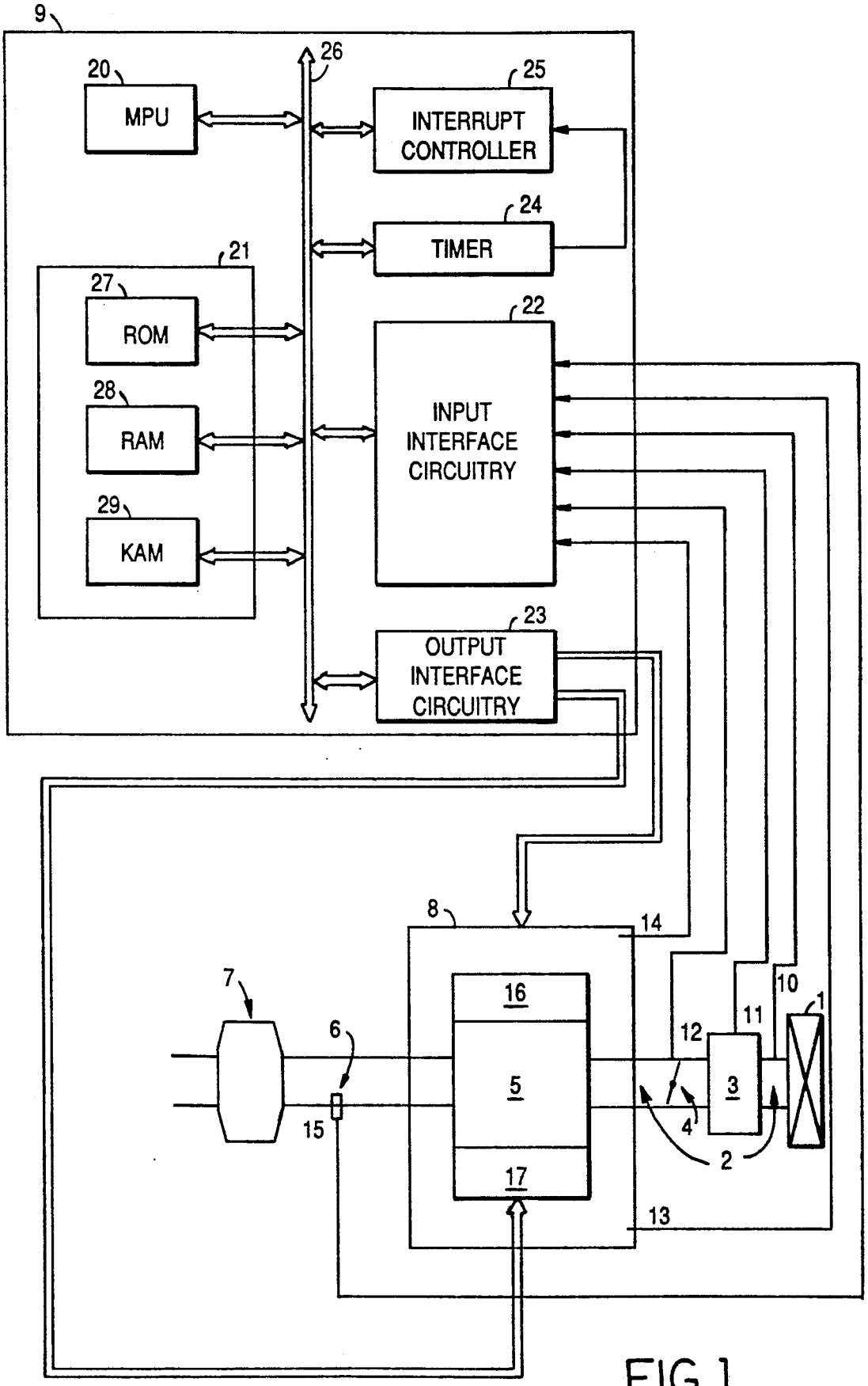
FIG. 1 is a block diagram of an internal combustion engine with an electronic control unit for adaptive air/fuel ratio control.

FIG. 1 is a simplified block diagram of an internal combustion engine with the electronic control unit for the adaptive air/fuel ratio control of the mixture supplied to the engine in accordance with the principles of the present invention. In FIG. 1, air enters an air passage 2 through an air cleaner 1 and passes to the combustion chamber 8 of the engine through an airflow meter 3 and a throttle valve 4 via an inlet manifold 5. The exhaust from the combustion chamber 8 is carried through an exhaust passage 6 and a catalyst 7. An electronic control unit 9 monitors the input signals from a variety of engine sensors 10, 11, 12, 13, 14, 15, to determine the engine operating conditions and generates appropriate ignition pulses to spark plugs 16 at the appropriate time to ignite the air/fuel mixture which enters the combustion chamber. In addition, control unit 9 calculates the appropriate fuel injection pulse time duration and applies it to fuel injectors 17 at the appropriate time in order to obtain the desired air/fuel ratio.

Air charge temperature sensor 10 is used to measure the temperature of the intake air which flows through the intake air passage. Airflow sensor 11 is used to measure the airflow rate which represents the engine load. The airflow rate is also used to determine the air mass entering the inlet manifold. Throttle valve position sensor 12 indicates the throttle position which is used as a condition for the open-loop fuel or closed-loop fuel control. Engine coolant temperature sensor 13 measures the temperature of the engine. Engine revolution sensor 14 measures the engine speed. Exhaust gas oxygen sensor 15 monitors the oxygen level in the exhaust gas when in closed-loop fuel control to indicate whether the engine is running on the lean side or the rich side so that the air/fuel ratio can be adjusted accordingly by electronic control unit 9.

Electronic control unit 9 contains a microprocessor unit MPU 20, a memory unit 21, an input interface circuitry 22 which contains buffers, A/D converters, etc., an output interface circuitry 23 which contains buffers, drivers etc., a timer 24, an interrupt controller 25, and an internal bus 26 connecting all these components. Memory units 21 have a read-only memory (ROM) 27 for storing the engine control program including an adaptive air/fuel ratio control routine and related constants, a read-write memory (RAM) 28 for use as counters or timers or as temporary registers for storing data, a keep-alive memory (KAM) 29 for storing learned value for the learning control correction factor. The KAM 29 is always powered even if the ignition key (not shown) is turned off. Timer 24 can be set to a fixed time which is then continuously counted down. When it counts down and passes zero, an interrupt signal will be generated which is sent to interrupt controller 25 to generate an interrupt signal to the MPU and activates a special service routine.

The normalized air/fuel ratio with respect to stoichiometry is given by $$LAMBDA = AM / (14.64 * FM)$$

where,

AM = air mass in 1 bm/min.

FM = fuel mass flow in 1 bm/min.

LAMBDA = normalized air/fuel ratio.

By measuring the air mass AM and determining the desired normalized air/fuel ratio LAMBDA based on the operating condition, the fuel mass FM can thus be obtained by $$FM = AM / (14.64 * LAMBDA)$$

and the fuel pulse time duration t can be obtained by $$t = FM * c$$

where, c is the conversion factor

The corrected fuel pulse time duration $T_c$ is obtained by multiplying t by the adaptive learning control correction factor $L_c$ at the present engine operating point:

$$T_c = t * L_c$$

The main function of the adaptive air/fuel ratio control logic is to properly update the learning control correction factor at the appropriate time. The values for the learning control correction factor at different operating points are stored in an array form in keep-alive memory (KAM) 29 which is continuously powered by the vehicle battery even when the vehicle is shut off. Each memory cell in KAM 29 is addressed by the engine operating condition defined by parameters such as the engine load and engine speed. For illustration purposes, in the following discussion, the engine operating condition used to address the memory cell to update is defined only by the engine load which is determined by the intake airflow.

Figures 2, 3:
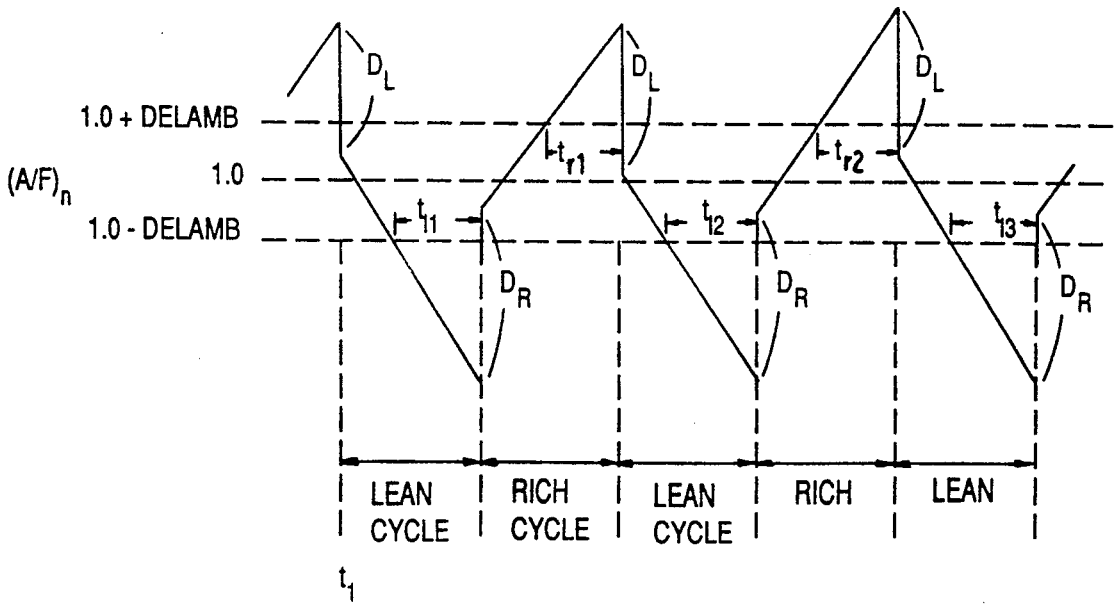
FIG. 2 is an example of a function FN025 (VMAF) for addressing adaptive keep-alive memory (KAM) cells.
FIG. 3 is a graphical illustration of normalized air/fuel ratio in accordance with an embodiment of this invention.

Accordingly, in the embodiments described below when it is time to update the learning control correction factor, the memory cell in KAM 29 to be updated is determined by a linear function FN025 (VMAF), where VMAF is the mass airflow in voltage obtained by converting the A/D count from the airflow measuring circuitry. The input to this function is VMAF and the output is the cell number in KAM 29. An example of this function with an array size 32 is shown in FIG. 2. Higher accuracy can be obtained by enlarging the array size, to say 64. The procedure to determine the cell number in KAM 29 for a certain VMAF value is: a) use FN025 to determine a cell number with integer and fraction portions by the linear interpolation process, and b) round the result obtained in step a) and use the resultant integer as the cell number. When it is time to obtain the learning control correction factor $L_c$ for calculating the actual injection pulse time duration $T_c$, FN025 and current VMAF value are used to determine a cell number with integer and fraction portions by the linear interpolation process. The value for the learning control correction factor $L_c$ is then obtained by the linear interpolation process using the contents of the KAM cells addressed by the integer and fraction obtained previously.

In open loop fuel operation, the desired air/fuel ratio is determined by a predetermined table based on the engine operating conditions such as load, engine speed, engine coolant temperature, etc. In closed-loop fuel operation, the desired normalized air/fuel ratio is constantly decremented when the EGO sensor indicates lean until a transition from lean to rich is sensed, and the air/fuel ratio is constantly incremented when the EGO sensor indicates rich until a transition from rich to lean is sensed. At the time when the EGO sensor senses a transition from rich to lean status, because of the transport delay of the system, the air/fuel ratio is in fact too large.

In order to make the air/fuel ratio converge faster towards stoichiometry, the air/fuel ratio is decremented by an amount when the EGO sensor indicates a rich to lean transition. Likewise, the air/fuel ratio is incremented by an amount when the EGO sensor indicates a lean to rich transition. Accordingly, in the normal closed-loop fuel operation, the interleaved lean cycle and rich cycle continue and the desired normalized air/fuel ratio should stay in the neighborhood of stoichiometry (i.e., 1.0) regardless whether it is in lean cycle or in rich cycle. The system's rich or lean status is measured by the time period difference between the time period that the air/fuel ratio is greater than an upper limit and the time period that the air/fuel ratio is less than the lower limit in equal number of successive rich and lean cycles. If the time period that the air/fuel ratio is greater than an upper limit is greater than the time period that the air/fuel ratio is less than a lower limit in equal number of successive rich and lean cycles, the system is rich. Conversely, if the time period that the air/fuel ratio is less than a lower limit is greater than the time period that the air/fuel ratio is greater than an upper limit in equal number of successive rich and lean cycles, the system is lean. The time period difference also indicates the degree that the system is too rich or too lean. The bigger the time period difference is, the farther off the system is away from the stoichiometry. Consequently, the adjusting amount for the learning control factor is determined by making it proportional to the time period difference.

FIG. 3 graphically illustrates the principle of the present invention. In the closed loop fuel control, the normalized desired air/fuel ratio $(A/F)_n$ is constantly incremented when the EGO sensor indicates rich until the EGO sensor senses a rich to lean transition. At that time, $(A/F)_n$ is instantaneously decremented by an amount $D_L$ which can be a constant or can be a function of the current $(A/F)_n$ and the previous modified $(A/F)_n$ when a lean to rich transition occurred. Thereafter, $(A/F)_n$ is constantly decremented until the EGO sensor senses a lean to rich transition. At that instant, $(A/F)_n$ is instantaneously incremented by an amount $D_R$ which again can be a constant or can be a function of the current $(A/F)_n$ and the previous modified $(A/F)_n$ when a rich to lean transition occurred. In this manner, the rich cycles interleave the lean cycles as shown in FIG. 3.

Referring to FIG. 3, at time $t_1$, the EGO sensor indicates a rich to lean transition. The time period $t_{11}$ is the duration that $(A/F)_n$ is smaller than a lower limit during the first lean cycle after $t_1$. While, the time period $t_{r1}$ is the duration that $(A/F)_n$ is greater than an upper limit during the first rich cycle after $t_1$. If $t_{r1}$ is greater than $t_{11}$ then the system is running rich during the first lean and rich cycle as it spends more time in the rich cycle than in the lean cycle. Conversely, if $t_{r1}$ is less than $t_{11}$ then the system is running lean during the first lean and rich cycle as it spends more time in the lean cycle than in the rich cycle. The absolute difference value between these two time period, that is, $|t_{r1}-t_{11}|$, also indicates how far off the system is away from the stoichiometry during the first complete rich and lean cycles. The adjusting amount to the learning control correction factor can thus be made proportional to $t_{r1}-t_{11}$, for instance, $k^*|(t_{r1}-t_{11})|$, where k is a scaling factor. This concept can be extended to the more general case in which the time period for $(A/F)_n$ being smaller than a lower limit are accounted for during equal number of successive interleaved rich and lean cycles. As an example, in FIG. 3, if $(t_{r1}+t_{r2})>(t_{11}+t_{12})$ then the system is running rich during the two successive interleaved lean and rich cycles after $t_1$.

Two implementations of the present invention are now discussed. The first is to use two different timers: a rich timer and a lean timer. The rich timer is used to record the time period when $(A/F)_n$ is greater than an upper limit; while, the lean timer is used to record the time period when $(A/F)_n$ is less than a lower limit. The difference between these two timers at the end of an equal number of successive rich and lean cycles determines whether the system is running rich or lean during that period. If the contents of the rich timer are greater than those of the lean timer, the system is running rich; and vice versa. The second implementation is to use on single timer: a rich/lean difference timer. This difference timer is incremented when $(A/F)_n$ is greater than the upper limit and decremented when $(A/F)_n$ is less than a lower limit. At the end of equal number of successive rich and lean cycles, the contents of the difference timer determine whether the system is running rich or lean during that period. If the contents of the difference timer are positive, the system is running rich; while, if the contents of the difference timer are negative, the system is running lean. The second implementation requires less memory as well as less processing time than the first implementation. Two preferred embodiments to be discussed use only one difference timer.

Figure 4:
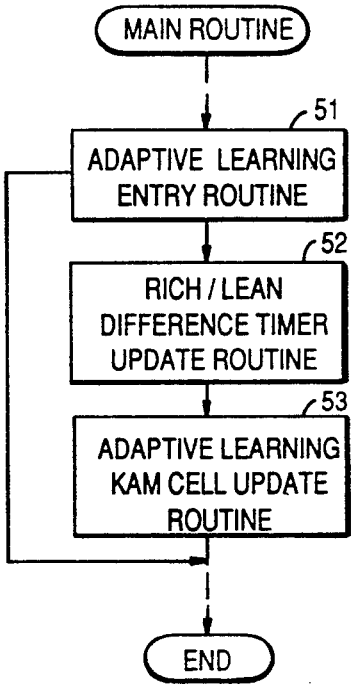
FIG. 4 is a flow chart of a part of a main routine for an adaptive air/fuel ratio control in accordance with an embodiment of this invention.

FIG. 4 shows a flow chart of a part of a main routine for controlling the engine operation. In this main routine, the process is returned to the first step after the process has completed the last step. In other words, the process is carried out repeatedly for as long as the engine is running. This part of the main routine as shown in FIG. 4 contains three steps: step 51, step 52, and step 53, which form the substance of the adaptive air/fuel ratio control strategy. In step 51, the adaptive learning entry routine is performed. If the adaptive learning condition is satisfied the process proceeds to step 52; otherwise, the process is discontinued and step 52 and step 53 are omitted. In step 52, the rich/lean difference timer update routine is executed. Step 53 begins after step 52 is carried out. In step 53, the adaptive learning KAM cell update routine is carried out. Each of these steps will be elaborated further in the following paragraphs.

Figure 5:
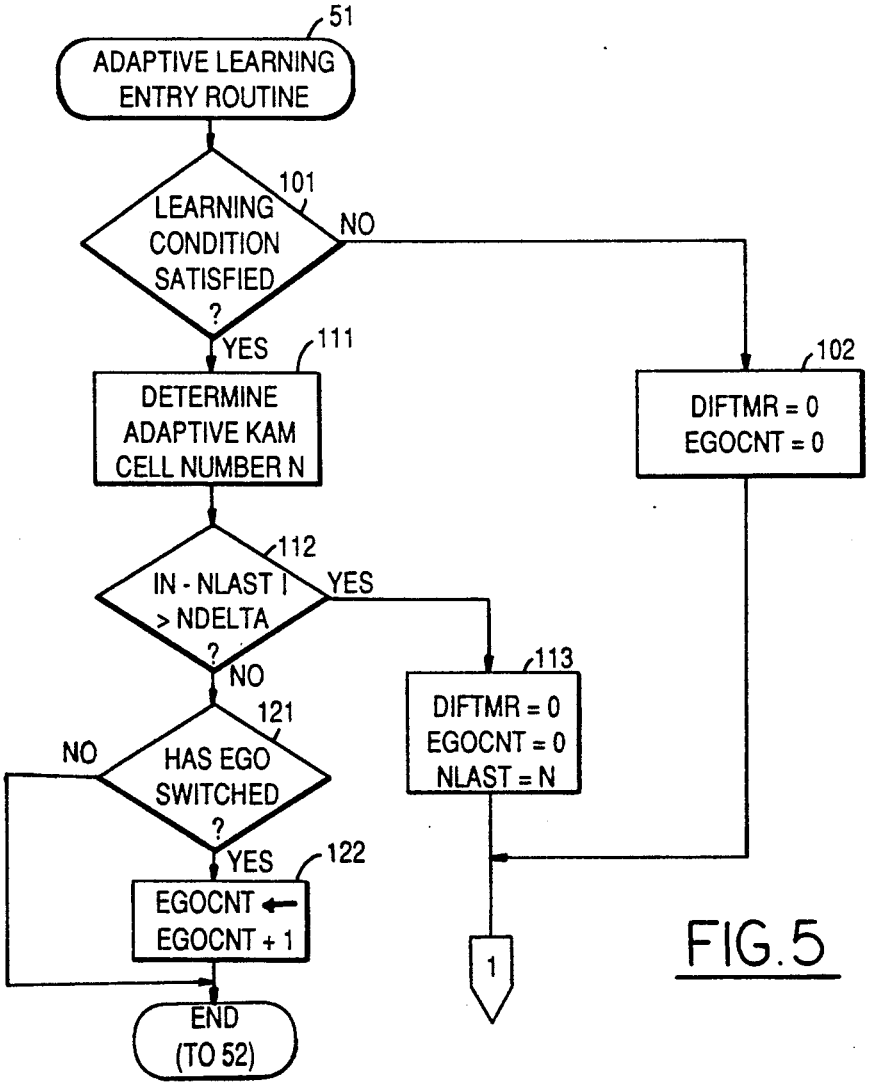
FIG. 5 is a flow chart of an adaptive learning entry routine in accordance with an embodiment of the invention.

FIG. 5 illustrates the adaptive learning entry routine 51. In step 101, it is determined whether or not the adaptive learning condition is satisfied. In this embodiment, the learning condition is satisfied when the closed-loop fuel control is being carried out, the acceleration enrichment fuel strategy is not activated, the air charge temperature (ACT) is in the range between AFACT1 and AFACT2 (i.e., AFACT1<ACT<AFACT2), the engine coolant temperature (ECT) is in the range between AFECT1 and AFECT2 (i.e., AFECT1<ECT<AFECT2), and when the adaptive timer ADPTMR has exceeded a predetermined time, for example, ADAPTM seconds. The adaptive timer ADPTMR is cleared during engine crank or when the ECT is greater than an upper limit AFECT2 or the ECT is less than a lower limit AFECT1. In other cases, ADPTMR is continuously incremented by 1 for every second until the maximum value is achieved. The parameters AFACT1, AFACT2, AFECT1, AFECT2, and ADAPTM are calibration constants.

When the learning entry condition is satisfied, the process proceeds to step 111. If the learning entry condition is not satisfied, the process proceeds to step 102, where a rich/lean difference timer DIFTMR and an EGO switch counter EGOCNT are reset to 0. Then step 52 and 53 are omitted and the whole learning Process is discontinued.

In step 111, the memory cell 'N' to be updated in the special KAM is determined based on VMAF value and function FN025 using the linear interpolation process as described previously. In step 112, the difference between the current memory cell number N and the previously recorded memory cell number NLAST is checked. This check is to ensure that the learning process is carried out when the vehicle is operating under rather constant operating condition. If $|N-NLAST|>NDELTA$, where NDELTA is calibration constant, the operating points are too far off to be practical for the learning process to continue. In this case, the process proceeds to step 113, where DIFTMR and EGOCNT are reset to 0 and NLAST is set equal to N, routine 51 is then exited and the rest of the learning steps are omitted. If $|N-NLAST|\leqq NDELTA$, the process proceeds to step 121, where the status of the exhaust gas oxygen sensor output is checked. If the EGO sensor indicates a transition from lean to rich or vice versa since the previous EGO status check, the process goes to step 122, where the EGO switch counter EGOCNT is incremented by 1. Then routine 51 is ended. If the output status of the EGO sensor has not changed since the previous check, step 122 is omitted and routine 51 is terminated.

Figure 6:
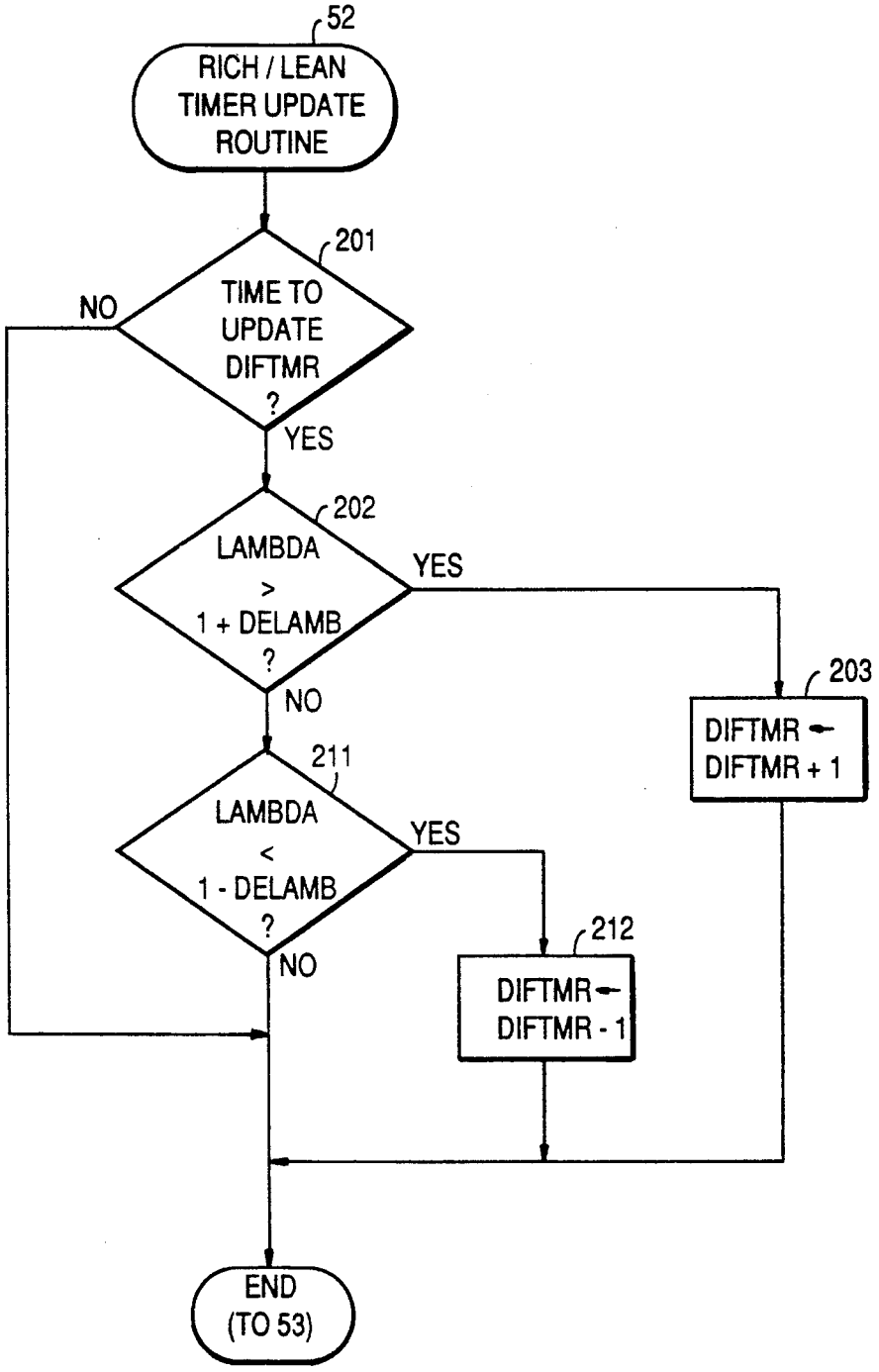
FIG. 6 is a flow chart of a rich/lean difference timer update routine in accordance with an embodiment of this invention.

FIG. 6 illustrates the rich/lean difference timer update routine 52. In step 201, it is determined whether or not it is the appropriate time to update the rich/lean difference timer DIFTMR. The condition which allows to update DIFTMR is that $EGOCTL\leqq EGOCNT<EGOCTL+2*EGOCYC$. In the normal closed-loop fuel operation, a rich cycle is followed by a lean cycle and vice versa. Accordingly, the above condition means that right after EGO sensor has sensed EGOCTL number of rich-to-lean or lean-to-rich transitions, DIFTMR begins to be updated. Thereafter, DIFTMR continues to be updated during an equal predetermined number EGOCYC of successive rich and lean cycle period. EGOCTL and EGOCYC are calibration constants. Note that EGOCTL has to be at least 1 to ensure DIFTMR is not updated until after the EGO status has just switched so that DIFTMR is updated for a complete rich or lean cycle. EGOCTL partially controls the adaptive learning cell update rate. Maximum update rate is achieved when EGOCTL=1. EGOCYC also control the learning rate in Part. However, its major function is to control the responsiveness of the adaptive system to the air/fuel ratio change. Obviously, maximum responsiveness is achieved when EGOCYC=1. However, higher value for EGOCYC can reduce the effect of the abrupt change of the EGO status due to noise. Higher EGOCYC can also minimize the errors due to the timer counting inaccuracy as it tends to average the process.

In step 201, if it is determined it is not time to update DIFTMR, i.e., either EGOCNT<EGOCTL or $EGOCNT\leqq EGOCTL+2*EGOCYC$, the rest of the steps are omitted and routine 52 is ended. Otherwise, the process proceeds to to step 202. In step 202, it is determined whether or not the normalized air/fuel ratio LAMBDA is greater than an upper limit (1.0+DELAMB), where DELAMB is a calibration constant. If it is, the process proceeds to step 203 to increment the rich/lean difference timer DIFTMR by 1. Then routine 52 is ended. If in step 202, it is determined that the normalized air/fuel ratio LAMBDA is less than or equal to the upper limit, step 211 is carried out. In step 211, it is determined whether or not LAMBDA is less than a lower limit (1.0−DELAMB). If it is, the process proceeds to step 212, where the rich/lean difference timer DIFTMR is decremented by 1. Then routine 52 is ended. If in step 211, it is determined that LAMBDA is greater than or equal to the lower limit, timer DIFTMR remains unchanged and routine 52 is terminated. Note that when DIFTMR is incremented, it is clipped to a maximum, DIFMAX, to avoid the overflow problem. Similarly, when DIFTMR is decremented, it is clipped to a minimum, DIFMIN, to avoid the underflow problem.

At the end of the rich/lean difference timer update period, i.e., when $EGOCNT=EGOCTL+2*EGOCYC$, the amount stored in timer DIFTMR not only tells whether the system was biased towards the rich or the lean side but also indicates the degree that it was operating away from the stoichiometry during the DIFTMR update period. Thus, the next step is to check the rich or lean status of the system and adjust it towards stoichiometry. In other words, if the system is operating rich, it is desired to reduce the fuel flow by reducing the learning control correction factor $L_c$. This can be achieved by decreasing the value in the KAM cell corresponding to the operating point. Conversely, if the system is operating lean, it is desired to increase the fuel flow by increasing the value in the KAM cell corresponding to the operating point. Since the value in timer DIFTMR indicates the degree that the system is away from stoichiometry, it is most suitable to use an adaptive amount $k*|DIFTMR|$ as the incremental amount or decremental amount for the value stored in the KAM cell corresponding to the operating point, where k is a calibration constant.

Figure 7:
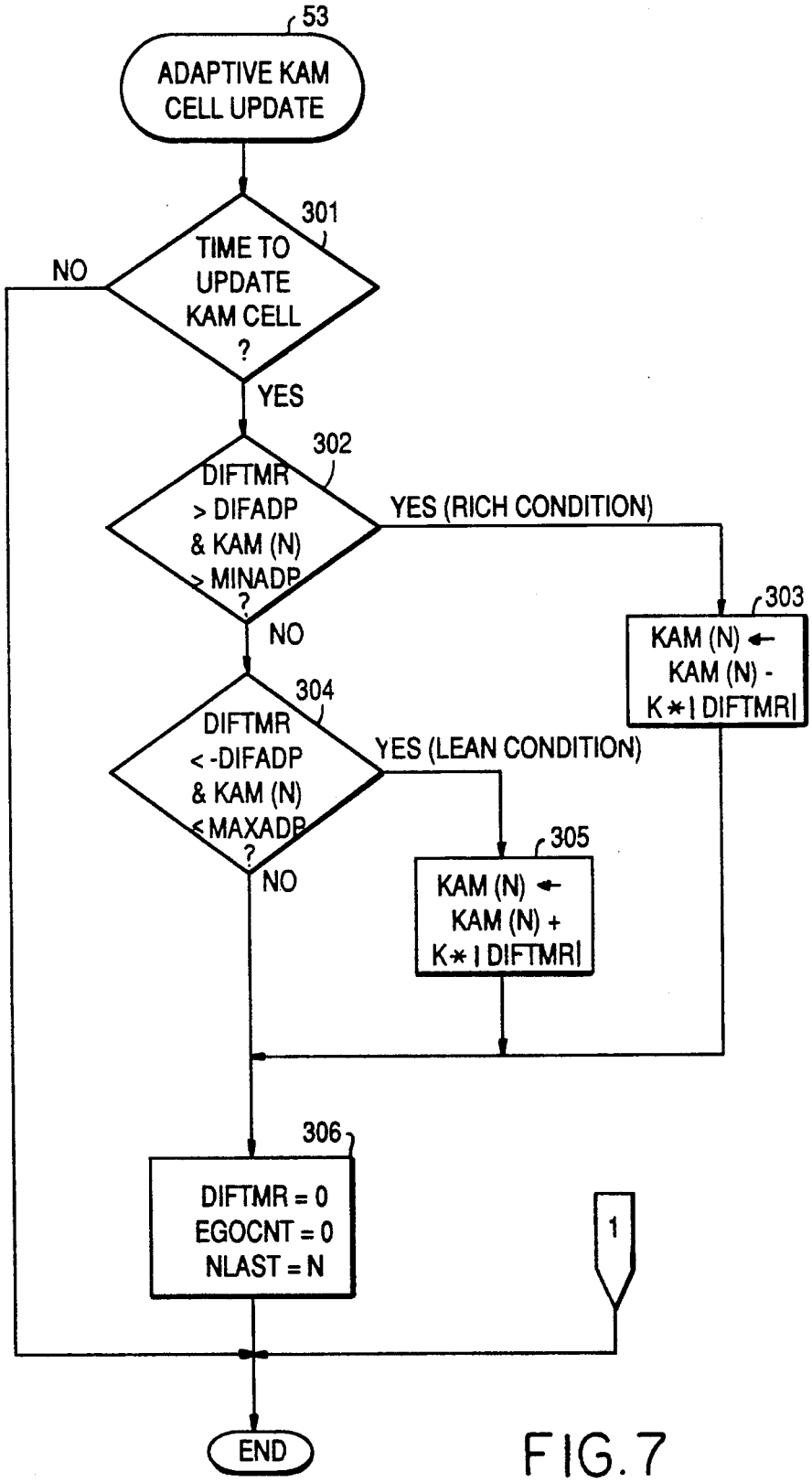
FIG. 7 is a flow chart of an adaptive KAM cell update routine in accordance with an embodiment of this invention.

FIG. 7 illustrates such an adaptive KAM cell update routine 53. The purpose of this routine is to change the value stored in the KAM cell corresponding to the operating point so that the system is adjusted towards stoichiometry. In step 301, it is determined whether or not it is time to update the KAM cell. When EGOCNT->or=EGOCTL+2*EGOCYC, the update process for DIFTMR has stopped, and thus it is time to update the KAM cell and the process proceeds to step 302. In step 302, it is determined whether or not the system was biased towards the rich side. If it is and DIFTMR is greater than an upper threshold DIFADP and the KAM cell corresponding to the operating point, i.e., KAM(N), contains a value greater than the lower limit MIDADP, then the process proceeds to step 303, where the adaptive amount k* |DIFTMR| is subtracted from KAM(N). The resultant KAM(N) is then clipped to the minimum, MINADP. Then the process proceeds to step 306, where the rich/lean difference timer DIFTMR and the EGO switch counter EGOCNT are reset to 0 and NLAST is set equal to N. Routine 53 is then ended. If any of the conditions checked in step 302 is not true, the process proceeds to step 304, where whether the system was biased towards the lean side is checked. If it is and DIFTMR is less than a lower threshold −DIFADP and KAM(N) is less than an upper limit MAXADP, the process proceeds to step 305, where, the adaptive amount is added to KAM(N). The resultant KAM(N) is then clipped to the maximum, MAXADP. The above-mentioned parameters DIFADP, MINADP, and MAXADP are calibration constants. If DIFTMR is in between the lower threshold and the upper threshold, that is, −DIFADP≦DIFTMR≦DIFADP, then it is not necessary to update the KAM cell, and the process proceeds from step 304 to step 306 to clear DIFTMR and EGOCNT and set NLAST equal to N.

In this embodiment described as above, after the condition for updating the rich/lean difference timer is satisfied, DIFTMR is incremented or decremented by 1 per background loop based on LAMBDA value. Therefore, the contents of DIFTMR are not the actual time but a multiple of the background loop time. This background loop time may vary in accord with the system's operating condition. Consequently, the time period difference obtained is not always accurate. A more accurate method of measuring the time period is to update DIFTMR at fixed timer after the condition for updating the rich/lean difference timer is met.

Figure 8:
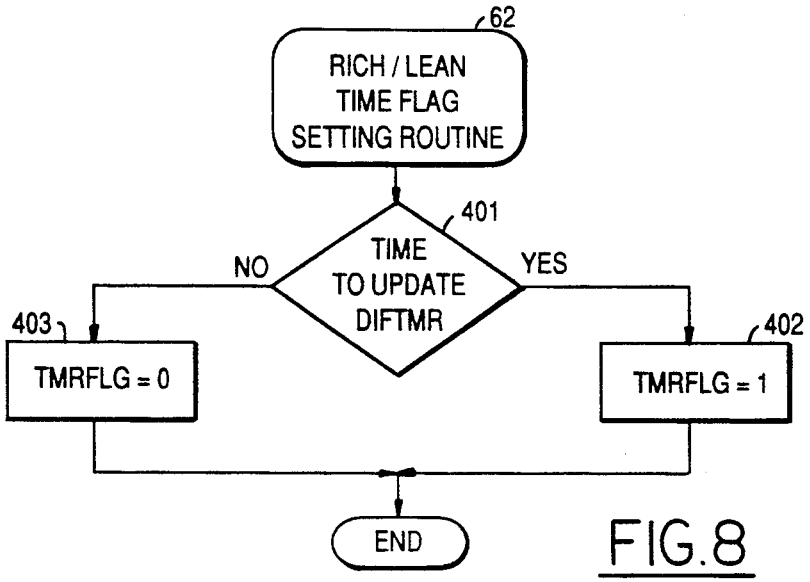
FIG. 8 is a flow chart of a rich lean difference timer flag setting routine in accordance with another embodiment of this invention.
Figure 9:
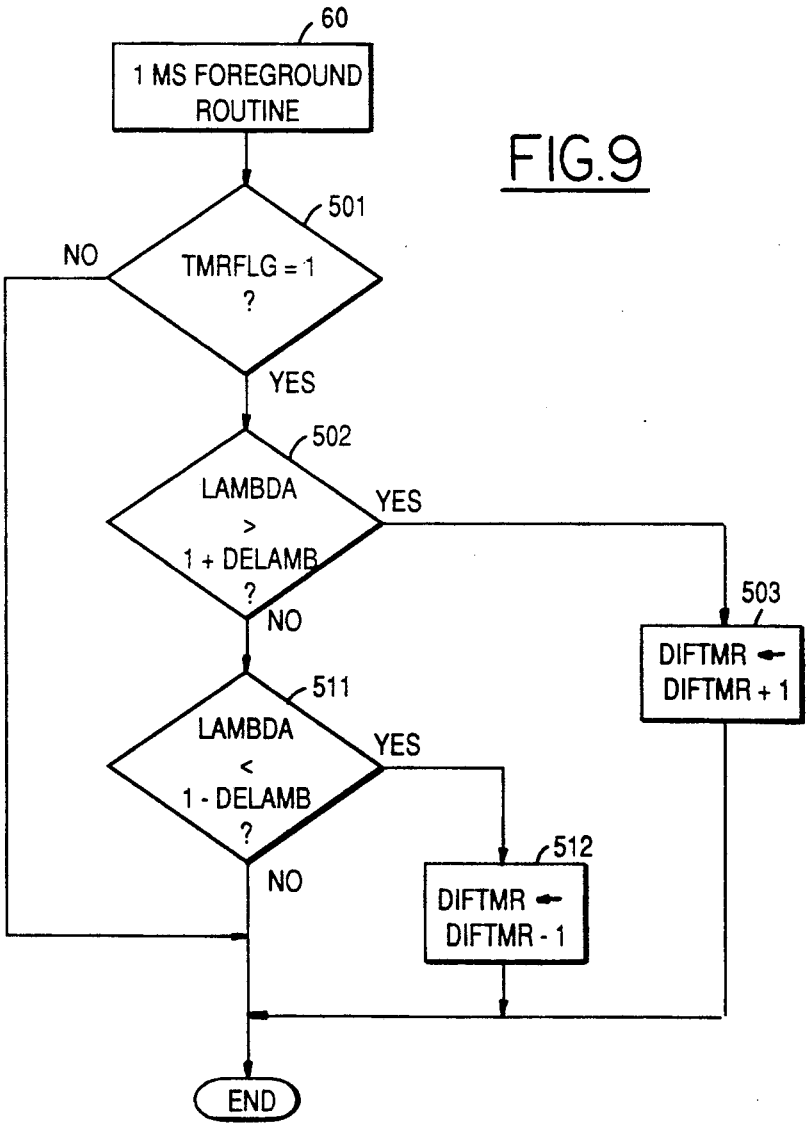
FIG. 9 is a flow chart of a 1-ms foreground routine similar to FIG. 6 for updating the rich/lean difference timer in accordance with the second embodiment.

This results in another embodiment of the present invention. In this second embodiment, a foreground interrupt service routine 60 as shown in FIG. 9 which is activated every 1 ms is included and the rich/lean difference timer update routine 52 as shown in FIG. 6 has to be replaced by a new routine 62 as shown in FIG. 8. In addition, routine 51 has to be slightly modified, which will be explained later. But, routine 53 remains the same. Therefore, in this second embodiment, the flow of the main routine is similar to that of the first embodiment as shown in FIG. 4. That is, a slightly modified adaptive learning entry routine is executed first, followed by routine 62, then followed by routine 53. The new 1 ms foreground routine 60 is carried out once every 1 ms and is independent of the execution of the main routine.

Referring to FIG. 8, in step 401 whether it is time to update DIFTMR is examined. This step is the same as step 201 in FIG. 6. If it is time to update DIFTMR, a flag TMRFLG is set to 1 in step 402; otherwise, the flag TMRFLG is cleared to 0 in step 403. Then routine 62 is terminated. In the foreground routine 60 as shown in FIG. 9 and which is activated every 1 ms, the flag TMRFLG is first checked in step 501. If TMRFLG is 0, it is not time to update DIFTMR, routine 60 is exited. If TMRFLG is 1, it is time to update DIFTMR, the process proceeds to step 502. In step 502, the normalized air/fuel ratio LAMBDA is checked. If LAMBDA is greater than an upper limit (1.0+DELAMB), the process proceeds to step 503 to increment DIFTMR by 1; otherwise, the process proceeds to step 511 to check if LAMBDA is less than a lower limit (1.0−DELAMB). If LAMBDA is less than the lower limit, DIFTMR is decremented by 1 in step 512; otherwise, foreground routine 60 is terminated. Because routine 60 is executed once every 1 ms, DIFTMR will be incremented or decremented if TMRFLG is set and LAMBDA is greater than an upper limit or less than a lower limit. In order to ensure that DIFTMR is not erroneously updated when the adaptive learning condition is not satisfied or when, |N−NLAST>NDELTA, step 102 and step 113 in the adaptive learning entry routine 51 have to be modified to include an operation to clear flag TMRFLG in addition to resetting EGOCNT and DIFTMR.

Various modifications and variations will no doubt occur to those skilled in the arts to which this invention pertains. For example, the method of determining the KAM cell number may be varied from those described herein. These and all other variations which basically rely on the teachings through which this disclosure has advanced the art are properly considered within the scope of this invention.

What is claimed:

1. A method of controlling air/fuel ratio for an engine control system of an internal combustion engine having a learning control correction factor for altering the air/fuel ratio including the steps of:

establishing an upper and a lower limit for the air/fuel ratio;

determining the time period difference between a first time period during which the air/fuel ratio is greater than the upper limit and a second time period during which the air/fuel ratio is less than a lower limit during a rich and lean cycle;

determining the system is rich if the first time period is greater than the second time period; and determining the system is lean if the second time period is greater than the first time period.

2. A method as recited in claim 1 further comprising the step of:

determining the degree that the system is too rich or too lean.

3. A method as recited in claim 1 further comprising of the step of:

adjusting the amount of the learning control correction factor by making it proportional to the time period difference.

4. A method as recited in claim 3 further comprising the step of:

updating the learning control correction factor if the time period differences for rich and lean cycles have been calculated over a predetermined number of rich and lean cycle periods.

5. A method as recited in claim 4 further including entering an adaptive learning routine using the steps of:

determining whether a learning entry condition has been satisfied so that engine operation is suitable for use of the adaptive learning routine;

if the learning entry condition is not satisfied, a rich-/lean difference timer and an EGO switch counter, to monitor output transitions between rich and lean of an EGO sensor, are set to zero and the learning process is discontinued;

if the learning entry condition has been satisfied determining an adaptive keep-alive memory cell number as a function of engine operating conditions;

determining the difference between the current memory cell number and a previously recorded memory cell number;

comparing the difference between the current memory cell number and the previously recorded memory cell number to a predetermined cell number variance;

if the cell number difference is greater than the predetermined cell number variance, setting the rich-/lean difference timer and the EGO switch counter to zero and setting the magnitude of the previously recorded memory cell number to the present memory cell number; and if the cell number difference is not greater than the predetermined cell number variance, determining if the EGO sensor is switched or not, and incrementing the EGO switch count if there has been switching.

6. A method as recited in claim 5 further comprising a rich/lean difference timer update routine including the steps of:

determining whether or not the appropriate time to update a rich/lean difference timer has occurred based on the EGO switch count; and if the EGO switch count is greater than or equal to a predetermined number, updating the rich/lean different timer until a predetermined number of complete rich and lean cycles have elapsed.

7. A method as recited in claim 6 wherein the step of determining the time period difference between the first time period and the second time period includes incrementing or decrementing one rich/lean difference timer in response to a rich or lean condition.

8. A method as recited in claim 4 further comprising a first timer and a second timer update routine including the steps of:

determining whether or not the appropriate time to update a first timer and a second timer has occurred based on the EGO switch count; and if the EGO switch count is equal to or greater than a predetermined number, updating the first timer or the second timer until a predetermined number of complete rich and lean cycles have elapsed.

9. A method as recited in claim 8 wherein the step of determining the time period difference between the first time period and the second time period includes:

incrementing a first timer in response to a rich air/fuel ratio condition;

incrementing a second timer in response to a lean air/fuel ratio condition; and determining the difference between the contents of the two timers.

10. A method of controlling air/fuel ratio for an engine control system of an internal combustion engine as recited in claim 4 wherein an adaptive learning entry routine includes the steps of:

determining if a learning condition is satisfied, said learning condition including the elements of carrying out closed loop fuel control, not activating an acceleration enrichment fuel strategy, maintaining air charge temperature within a predetermined range, maintaining engine coolant temperature within a predetermined range, and having an adaptive timer exceed a predetermined time;

if the learning condition is not satisfied a rich/lean difference timer and an EGO switch counter are reset and the learning entry routine is terminated, otherwise, if the learning condition is satisfied, the following steps are performed:

selecting a keep-alive memory cell from a plurality of keep-alive memory cells based on the engine operating condition;

determining the difference between the current memory cell number and a last previously recorded memory cell number;

if the difference between the memory cell numbers is larger than a predetermined memory cell variance, the learning process terminates;

if the difference between the memory cell numbers is smaller than a predetermined memory cell variance, the status of an exhaust gas oxygen (EGO) sensor output is checked;

if the EGO sensor indicates a transition between rich and lean, the EGO switch counter is incremented by one; and if the EGO sensor indicates no transition between rich and lean, the routine is terminated.

11. A method of controlling air/fuel ratio as recited in claim 6 wherein a rich/lean difference timer update routine includes the steps of:

determining whether or not to update a rich/lean difference timer;

if the rich/lean difference timer is not to be updated the update routine terminates;

if the rich/lean difference timer is to be updated, a determination is made whether or not the normalized air/fuel ratio is greater than an upper limit;

if greater than the upper limit, the process proceeds to increment the rich/lean difference timer by one;

if not greater than the upper limit, it is determined whether the normalized air/fuel ratio is less than a lower limit;

if less than the lower limit, the rich/lean difference timer is decremented by one; and if not less than the lower limit, the difference timer update routine is terminated.

12. A method of controlling air/fuel ratio for an engine control system with an adaptive keep-alive memory having an update routine for changing the value stored in the keep-alive memory cell corresponding to the operating point so that system operation can be adaptively adjusted by changing a learning control correction factor for altering air/fuel ratio, the method including the steps of:

determining whether or not it is time to update the value stored in the keep-alive memory cell;

establishing a time to update if the EGO switch count is greater than a predetermined number indicating a predetermined number of rich and lean cycles have elapsed;

if it is not time to update, the routine is ended;

if it is time to update, determining whether or not the system is biased towards rich operation;

if it is biased toward rich operation, subtracting an adaptive amount from the value stored in the keep-alive memory in the cell, resetting a rich/lean difference timer and an EGO switch counter to zero and setting the previous memory cell number to the current memory cell number;

if the system is not biased toward rich operation, determining whether the system is biased towards lean operation;

if it is biased toward lean operation, adding an adaptive amount to the value stored in the keep-alive memory cell; and if it is not biased toward lean operation or if the keep-alive memory cell has been updated, clearing and setting to zero the rich/lean difference timer and the EGO switch counter, and setting the previous memory cell number to the current memory cell number.

13. A method controlling air/fuel ratio for an engine control system of an internal combustion engine having a learning control correction factor for altering the air/fuel ratio including the steps of:

determining whether it is appropriate to enter an adaptive learning routine;

determining whether to set a rich/lean time flag routine by determining whether it is time to update a difference timer and setting the timer flag to one if it is time to update and setting the timer flag to zero if it is not time to update;

updating an adaptive learning control correction factor, $L_c$, which can be used to determine a corrected fuel pulse time duration; and wherein determining whether to enter the adaptive learning routine includes periodically activating a foreground interrupt service routine includes checking the timer flag;

if the timer flag is zero, not updating a difference timer indicating the difference between rich and lean air/fuel ratio operating time;

if the timer flag is one, updating the difference timer indicating the difference between rich and lean air/fuel ratio operating time and determining a normalized air/fuel ratio LAMBDA;

if LAMBDA is greater than an upper limit, the difference timer is incremented by one;

if LAMBDA is not greater than an upper limit LAMBDA is checked to see if it is less than a lower limit; and if LAMBDA is less than a lower limit, the difference timer is decremented by one, otherwise the foreground routine is terminated.

14. A method of controlling an air/fuel ratio as recited in claim 13 wherein the step of determining whether to enter an adaptive learning routine includes the steps of:

determining whether a learning condition has been satisfied so that engine operation is suitable for use of the adaptive learning routine;

if the learning condition has been satisfied determining a current adaptive keep-alive memory cell number;

if the learning entry condition is not satisfied, a rich/lean difference timer, an EGO counter, and a timer flag are set to zero and the learning processes is discontinued;

determining the difference between the current memory cell number and a previously recorded memory cell number;

comparing the difference between the current memory cell number and the previous recorded memory cell number to a predetermined cell number variance parameter;

if the difference is larger than the predetermined cell number variance parameter, setting a rich/lean difference timer, an EGO counter, and a timer flag to zero and setting the value of the last cell number to the present cell number;

if the difference between the current memory cell number and the previous recorded memory cell number is not greater than the predetermined cell number variance parameter, determining if an exhaust gas oxygen (EGO) sensor has switched or not;

if the EGO sensor has switched, incrementing an EGO switching count and using adaptive learning.

15. A method of controlling air/fuel ratio as recited in claim 14 further including a foreground routine including the steps of:

establishing a predetermined time period;

checking a timer flag during the predetermined timer period to see if the flag is equal to one;

if the flag is not equal to one, terminating the routine;

if the flag is equal to one, determining whether the normalized air/fuel ratio is greater than a predetermined upper limit;

if greater than an upper limit, incrementing the rich/lean difference timer by one;

if not greater than an upper limit, checking the normalized air/fuel ratio to see if it is less than a predetermined lower limit;

if not less than the lower limit, process is terminated; and if less than the lower limit, the rich/lean difference timer is decremented by one.

16. A method as recited in claim 14 wherein the step of updating the stored learning factor in the selected cell of the keep-alive memory includes clipping the value of the stored learning factor so as not to exceed a maximum value.

17. A method as recited in claim 14 wherein the step of updating the stored learning factor includes clipping the stored learning factor so that the learning factor is not less than the minimum value.

18. A method of controlling air/fuel ratio for an engine control system of an internal combustion engine having a learning control correction factor for altering the air/fuel ratio including the steps of:

determining whether it is appropriate to enter an adaptive learning routine;

if the learning entry condition is not satisfied, a rich/lean difference timer, an EGO counter, and a timer flag are set to zero and the learning processes is discontinued;

if the learning condition has been satisfied determining a current adaptive keep-alive memory cell number;

determining the difference between the current memory cell number and a previously recorded memory cell number;

comparing the difference between the current memory cell number and the previous recorded memory cell number to a predetermined cell number variance parameter;

if the difference is larger than the predetermined cell number variance parameter, setting a rich/lean difference timer, an EGO counter, and a timer flag to zero and setting the value of the last cell number to the present cell number;

if the difference between the current memory cell number and the previous recorded memory cell number is not greater than the predetermined cell number variance parameter, determining if an exhaust gas oxygen (EGO) sensor has switched or not;

if the EGO sensor has switched, incrementing an EGO switching count;

determining whether to set a rich/lean time flag by determining whether it is time to update a difference timer and setting the timer flag to one if it is time to update and setting the timer flag to zero if it is not time to update;

updating an adaptive learning control correction factor, $L_c$, which can be used to determine a corrected fuel pulse time duration, including the steps of:

establishing an upper and lower limit for the air/fuel ratio;

periodically activating a foreground interrupt service routine includes checking the timer flag;

if the timer flag is zero, not updating a difference timer indicating the difference between rich and lean air/fuel ratio operating time;

if the timer flag is one, updating the difference timer indicating the difference between rich and lean air/fuel ratio operating time based on the value of a normalized air/fuel ratio LAMBDA;

if LAMBDA is greater than an upper limit, the difference timer is incremented by one;

if LAMBDA is not greater than an upper limit LAMBDA is checked to see if it is less than a lower limit;

if LAMBDA is less than a lower limit, the difference timer is decremented by one, otherwise the foreground routine is terminated;

determining the time period difference between a first time period during which the air/fuel ratio is greater than the upper limit and a second time period during which the air/fuel ratio is less than a lower limit during one or more complete rich and lean cycle;

determining the system is rich if the first time period is greater than the second time period;

determining the system is lean if the second time period is greater than the first time period;

determining the degree that the system is too rich or too lean;

adjusting the amount of the learning control correction factor by making it proportional to the time period difference;

clipping the value of the stored learning correction factor so as not to exceed a maximum value; and clipping the stored learning correction factor so that the learning factor is not less than the minimum value.

* * * * *